United States Patent [19]

Nishida et al.

[11] Patent Number: 4,956,011

[45] Date of Patent: Sep. 11, 1990

[54] IRON-SILICON ALLOY POWDER MAGNETIC CORES AND METHOD OF MANUFACTURING THE SAME

[75] Inventors: Tokuhiko Nishida; Masao Yamamiya, both of Kawasaki, Japan

[73] Assignee: Nippon Steel Corporation, Tokyo, Japan

[21] Appl. No.: 466,605

[22] Filed: Jan. 17, 1990

[51] Int. Cl.[5] ..... C22C 29/00

[52] U.S. Cl. ..... 75/230; 252/62.53; 252/62.54; 252/62.59; 419/10

[58] Field of Search ..... 252/62.53, 62.54, 62.59; 419/10; 75/230

[56] References Cited

U.S. PATENT DOCUMENTS

| | | | |
|---|---|---|---|
| 2,791,561 | 5/1957 | Beller et al. | 252/62.54 |
| 3,451,934 | 6/1969 | Hubbard | 252/62.54 |
| 4,385,944 | 5/1983 | Hasegawa | 148/104 |
| 4,502,982 | 3/1985 | Horie et al. | 252/513 |
| 4,601,753 | 7/1986 | Soileau et al. | 75/251 |
| 4,601,765 | 7/1986 | Soileau et al. | 148/104 |
| 4,696,725 | 9/1987 | Ochiai et al. | 252/62.54 |

*Primary Examiner*—Stephen J. Lechert, Jr.
*Assistant Examiner*—Leon Nigohosian
*Attorney, Agent, or Firm*—Wenderoth, Lind & Ponack

[57] ABSTRACT

An Fe-Si alloy powder magnetic core comprises an alloy powder of an average particle diameter of 10–100 μm, produced by water atomization, in which the composition by weight of the alloy powder is 2–12% silicon and 0.05–0.95% oxygen with the balance being essentially iron. The process of manufacturing the powder magnetic core is also disclosed.

6 Claims, 1 Drawing Sheet

No. 2 AND 8 ARE THE PRESENT INVENTION.
No. 4, 5 AND 10 ARE FOR COMPARISON,
No. 4; SENDUST, No. 5; PURE IRON, No. 10 IRON CARBONYL

No. 2 AND 8 ARE THE PRESENT INVENTION.
No. 4, 5 AND 10 ARE FOR COMPARISON,
No. 4; SENDUST, No. 5; PURE IRON, No. 10 IRON CARBONYL

IRON-SILICON ALLOY POWDER MAGNETIC CORES AND METHOD OF MANUFACTURING THE SAME

BACKGROUND OF THE INVENTION

1. Field of the Invention

This invention relates to iron-silicon alloy powder magnetic cores used in noise filters and choke coils for switching power supplies and a process of manufacturing such powder magnetic cores.

2. Description of the Prior Art

The prior art includes the following process for manufacturing materials for powder magnetic cores used in magnetic noise suppression and choke coils. Specifically, the process is as follows: magnetic metal powders including pure iron, carbonyl iron, Fe-Ni alloy (hereafter referred to as Permalloy), or Fe-Si-Al alloy (hereafter referred to as Sendust) to which insulating binders such as sodium silicate or epoxy resin are added are compacted under pressure of 1–15 ton/cm$^2$ and then heat-treated to relieve compression stresses (Japan Society of Powder and Powder Metallurgy, Magnetic Materials (1970), The Nikkan Kogyo Shimbun, Ltd.).

Pure iron powder cores are used in choke coils for switching power supplies at frequencies of 50 kHz or lower, transformers for ringing-choke-type power supply circuits, and noise suppressors in circuits in which low-frequency currents are superimposed.

Permalloy powder cores are used as cores for secondary-side smoothing chokes in switching power supplies in the frequency range of 100–150 kHz, and as noise-suppressors. Sendust powder cores can be used in the same frequency range as permalloy powder cores.

However, with recent requirements for severe control of high-frequency noise in electronic equipment, as well as for smaller and more compact equipment, powder cores of high permeability and low core loss are increasingly required. To manufacture powder cores, the powder particles are insulated by epoxy resin or sodium silicate tolavoid direct contact between powder particles and decrease eddy current .losses in the high-frequency region. Furthermore, pressing is used to increase density and obtain high permeability and low core loss.

In order to obtain high permeability, one needs to increase the packing density by high compacting pressure, but with conventional Sendust powder cores, the powder is extremely hard and resistant to plastic deformation, making high-pressure compacting difficult and markedly decreasing the life of dies.

Permalloy powder cores have higher permeability than pure iron powder cores and their high-frequency magnetic properties are excellent, but they are expensive and the adhesion of powder to insulating layer is insufficient so that the insulation between particles breaks down, markedly degrading magnetic properties in the high frequency region.

SUMMARY OF THE INVENTION

Therefore, an object of the present invention is to solve these problems by providing inexpensive Fe-Si alloy powder cores which have high permeability and low core loss.

Another object of the invention is to provide a method of manufacturing Fe-Si alloy powder cores which have high permeability and excellent magnetic properties in the high frequency region.

BRIEF DESCRIPTION OF THE DRAWING

The objects and features of the present invention will become more apparent from the following detailed description taken in conjunction with the accompanying drawing, in which.

DETAILED DESCRIPTION OF THE INVENTION

Figure 1:
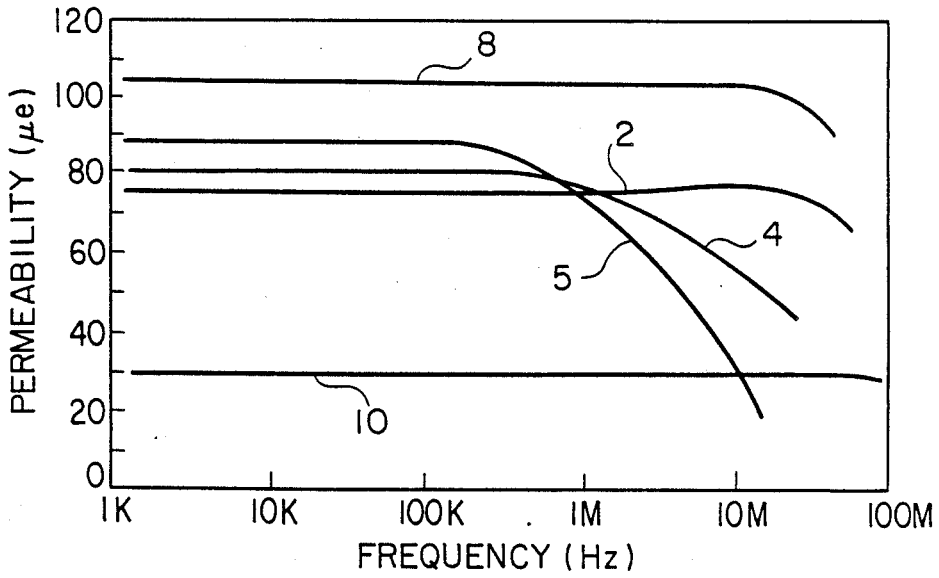
FIG. 1 shows the variation of permeability with the frequency for powder cores of this invention along with other powder cores for comparison.

The inventors studied the effects on magnetic characteristics of interlayer insulation, powder compacting, powder composition and other factors which affect the magnetic properties in the high frequency region. As a result of this research, they found that Fe-Si alloy powders produced by water atomization form a stable oxide layer on the surface of the particles and have excellent compressibility, so that they may be manufactured into powder cores of high permeability and low core loss.

Specifically, the invention is an Fe-Si alloy powder core manufactured by compacting an alloy powder of an average particle diameter of 10–100 μm, produced by water atomization, in which the composition by weight of the alloy powder is 2–12% silicon, 0.05–0.95% oxygen and the balance being essentially iron.

More specifically, it is an Fe-Si alloy powder core in which the composition by weight of the alloy powder is 2–12% silicon, 0.05–0.95% oxygen, with an Al, Cr and Ti content of less than 3% separately or combined, and the balance being essentially iron.

More specifically, it is a process of manufacturing Fe-Si alloy powder cores comprising the steps of adding an insulating binder to alloy powder of the above composition, compacting the resulting mixture and curing.

More specifically, it is a process of manufacturing Fe-Si alloy powder cores, comprising the above compacting step and curing step and a heat treatment step in which the compacted product is heat-treated in an inert atmosphere at a temperature between 500° C. and 950° C.

The following is an explanation of the reasons for limiting the invention in this manner.

The Si in the composition of the alloy powder of the invention is an essential compensation of this alloy, and if the Si content is less than 2%, electrical resistance will be decreased and eddy current losses in the high-frequency region will increase so that the desired permeability will not be obtained. If the Si content exceeds 12%, an intermetallic compound will be formed, making the powder hard and thus losing compressibility. The Si component is preferably between 3.0% and 7.5%, resulting in low magnetic anisotropy and magnetostriction.

Oxygen is vital to the formation of an insulating film on the surface of the powder, so if the oxygen content is less than 0.05%, a stable oxide layer will not be formed, and if greater than 0.95%, the oxide layer will become too thick, decreasing permeability and also decreasing the density of the green compacts. Therefore the oxygen content is in the range of 0.05–0.95%.

The Al, Cr and Ti added to the essential components as optional components have the effect of further enhancing the stability of the insulating layer formed. If any of the elements are added individually or together in an amount exceeding 3%, the film will grow too thick, and the compressibility of the powder will be lowered, hence the 3% limitation.

The particle size of the powder greatly affects permeability and the quality of interparticle insulation. If the average particle size is less than 10 μm, the magnetic properties of the powder itself will be impaired, and a high packing density cannot be obtained so the desired level of permeability will not be attained. On the other hand, if the particle size exceeds 100 μm, excessive friction between particles will damage the insulating layer, so the magnetic properties in the high-frequency region will be impaired, hence the range of 10–100 μm.

Water atomization is a process of producing metal powder in which the raw material is melted and this molten metal is dropped through a tundish nozzle as a downward stream of molten metal 2–20 mm in diameter. Water of high pressure, 50–800 kg/cm$^2$, is sprayed from an atomizing nozzle system onto this metal stream, which is disintegrated into fine droplets which solidify as powder (Metals Handbook Vol. 7, Page 25).

The water atomizing is easily controllable to obtain powder of the desired composition. In addition, since the metal is quenched by water, the particles are irregular in shape, giving the powder excellent compressibility and a low demagnetization factor. In addition, since the metal is oxidized by the water, the thickness of the oxide layer, and hence the oxygen content of the alloy powder, may be controlled by altering the atmosphere during atomization or altering the dissolved oxygen content of the water. Thus powder suited to the powder core of the invention may be produced.

In water atomization, an atomizing nozzle is provided on the inside top of an atomizing chamber. Molten metal is dropped as a fine stream from the top of the chamber and atomized as high-pressure water from the nozzle shrieks the metal stream. Thus if atomization is carried out in air as the atmosphere within the chamber, in the case of iron powder, the amount of oxygen of the powder will reach a level of 3–5%. If the chamber atmosphere is replaced by nitrogen, argon or other inert gas and the inside of the chamber is filled with water to rapidly quench the drops of atomized metal, the oxygen content of the iron powder can be decreased to about 1%. Furthermore, if Ar, $N_2$ or other gas is bubbled through the water used in atomizing and vacuum treatment employed to reduce dissolved oxygen in the water prior to atomization, the oxygen content of the iron powder can be decreased to less than 0.1. The dissolved oxygen content of the water can be altered to control the oxygen content of the powder within the range 0.05–0.95%.

Water-atomized Fe-Si alloy powder produced in this manner will have an average particle size of 10–100 μm after sieving. An insulating binder, typically sodium silicate, epoxy resin or if heat treatment will be carried out, a heat-resistant resin such as silicone resin will be added in the amount of 1–10% by weight and mixed. Next compacting under a pressure of 1–15 ton/cm$^2$ will be used to make compacts of the desired shape, and then hardening treatment and, if necessary, heat treatment will be carried out. Finally, an insulating coating is painted onto the surface and the powder core is manufactured.

After adding insulating binder to Fe-Si alloy particles and compacting, the compacts are hardened by a hardening treatment in which it is heated to 100–300° C., depending on the type of insulating binder and the application for the powder core. When heat treatment is carried out as described hereafter, the curing step may be omitted.

Note that in order to improve the adhesion of the resin or the like used as the insulating binder, it is preferable to treat the surface of the Fe-Si alloy powder used as the raw material with a Ti- or Si-based organometallic coupling agent.

While Fe-Si alloy powder can be used in this manner to manufacture powder cores having excellent electromagnetic properties, the electromagnetic properties may be further improved by heat-treating the compacted cores.

Heat treatment is effective when carried out at a temperature between 500° C. and 950° C. in an inert atmosphere of nitrogen or argon. As to the environment, ordinary air cannot be used because the alloy powder would oxidize, and hydrogen, cracked ammonia gas or other reducing environments alter the characteristics of the oxide layer. Thus a nitrogen or argon atmosphere is preferable.

As to the temperature, the relief of compacting stress is difficult at less than 500° C., while if 950° C. is exceeded, the insulating layer breaks down and the powder particles are sintered together and the magnetic properties in the high-frequency region deteriorate. Thus heat treatment at a temperature between 500° C. and 950° C. relieves stress in the core and causes the structure to change to improve electromagnetic properties by forming a superlattice structure.

As to the heat treatment time, the time should generally be longer at lower temperature and shorter at high temperature, but nevertheless it should be 1–20 hours, preferably 1–5 hours.

PREFERRED EMBODIMENT

Fe-Si alloy powders of various compositions as listed in Table 1 were fabricated and sieved to the desired average particle size.

The oxygen content of the alloy powder was altered by using Ar gas as the atomizing atmosphere and by bubbling Ar gas through the cooling water and atomizing water.

To these powders was added 1.5% by weight of epoxy resin and then the mixture was pressed at pressure of 8 ton/cm$^2$ into a ring of outside diameter 20 mm, inside diameter 12 mm and height 8 mm. Hardening treatment was then carried out at 150° C. for 2 hours, after which an impedance meter was used to measure the variation of permeability with frequency.

Before heat treatment was carried out, sodium silicate was added to the Fe-Si alloy powder in an amount of 1.0% by weight, and the mixture was pressed at a pressure of 8 ton/cm$^2$.

The heat treatment was carried out in an argon atmosphere.

The results of an evaluation of characteristics of the powder cores are listed in Table 1.

In the table, the notation $\mu e10K$ indicates the permeability at a frequency of 10 kHz, while $\mu e10M/\mu e10K$ indicates the ratio of permeability at 10 MHz to permeability at 10 kHz, and this is taken as an indication of the magnetic properties in the high-frequency region.

As is apparent from Table 1, the oxygen content of cores 1–9 of the invention is in the range 0.05–0.95%, the average particle size is in the range 10–100 μm and each core exhibits high permeability at 10 kHz of 70 or greater. Of particular note is the high-frequency properties in that the permeability at 10 MHz is the same or greater than the permeability at 10 kHz.

In particular, the cores of the invention which had been heat treated, namely cores 8–13, maintained a high permeability even up to the high-frequency region.

TABLE 1

| Samples | Metal powder composition (wt %) Si | Al | Ti | Cr | O | Fe | Other | Heat treatment conditions | Metal powder production method | Average particle size (μm) | Permeability (μe 10K) | High frequency magnetic properties (μe 10M/μe 10K) |
|---|---|---|---|---|---|---|---|---|---|---|---|---|
| This invention | | | | | | | | | | | | |
| 1 | 3.1 | — | — | — | 0.11 | bal. | — | none | Water atomization | 20 | 73 | 1.00 |
| 2 | 6.6 | — | — | — | 0.07 | " | — | " | " | 50 | 75 | 1.07 |
| 3 | 5.0 | 1.0 | — | — | 0.20 | " | — | " | " | 30 | 72 | 1.00 |
| 4 | 3.5 | 0.5 | 0.5 | 1.8 | 0.80 | " | — | " | " | 70 | 73 | 1.00 |
| 5 | 4.5 | — | 0.5 | — | 0.50 | " | — | " | " | 40 | 73 | 1.00 |
| 6 | 7.0 | — | — | 1.0 | 0.30 | " | — | " | " | 80 | 71 | 1.01 |
| 7 | 10.5 | — | — | — | 0.40 | " | — | " | " | 60 | 70 | 1.02 |
| 8 | 6.5 | — | — | — | 0.10 | " | — | 700° C. 2 hours | " | 25 | 105 | 1.00 |
| 9 | 4.0 | — | — | — | 0.25 | " | — | 800° C. 1 hour | " | 30 | 82 | 1.00 |
| 10 | 4.5 | 0.2 | — | — | 0.20 | " | — | 700° C. 2 hours | " | 30 | 80 | 1.00 |
| 11 | 4.5 | — | 0.3 | — | 0.20 | " | — | " | " | 30 | 81 | 1.00 |
| 12 | 4.5 | — | — | 0.5 | 0.30 | " | — | " | " | 30 | 81 | 1.00 |
| 13 | 4.2 | 0.3 | 1.0 | 0.5 | 0.70 | " | — | 900° C. 3 hours | " | 40 | 80 | 1.03 |
| Comparison | | | | | | | | | | | | |
| 1 | 3.0 | — | — | — | 0.15 | " | — | none | " | 8 | 25 | 0.60 |
| 2 | 2.5 | — | — | — | 0.20 | " | | " | " | 150 | 75 | 0.26 |
| 3 | 14.0 | — | — | — | 0.50 | " | | " | " | 40 | 30 | 0.30 |
| 4 | 9.5 | 5.5 | — | — | 0.25 | " | | " | " | 50 | 80 | 0.70 |
| 5 | 0.05 | — | — | — | 0.10 | " | | " | " | 200 | 89 | 0.34 |
| 6 | — | — | — | Mo 2 | 0.05 | " | Ni 81 | 750° C. 3 hours | " | 100 | 120 | 0.01 |
| 7 | 6.4 | — | — | — | 0.02 | " | — | none | Gas atomization | 40 | 30 | 0.40 |
| 8 | 6.7 | — | — | — | 1.03 | " | — | none | Water atomization | 50 | 35 | 0.20 |
| 9 | 3.5 | — | — | — | 0.20 | " | — | 1000° C. 1 hour | " | 30 | 100 | 0.01 |
| 10 | 0.02 | — | — | — | 0.30 | " | — | none | Iron carbonyl process | 5 | 30 | 1.00 |

Of the cores for comparison, the Sendust powder core 4, the pure iron powder core 5 and the Permalloy powder core 6 each have a higher permeability at 10 kHz than cores 1–5 of the invention, but a lower permeability at 10 MHz, so their high-frequency properties are inferior.

In addition, core 1 for comparison is made from powder of such small particle size that the magnetism of the powder itself is poor, while the particle size of core 2 for comparison is so large that the insulating performance is inferior in the high-frequency range.

In core 3 for comparison, in which the Si content exceeds 12%, the powder is so hard that the packing density is insufficient and the permeability at 10 kHz is low.

In core 7 for comparison, the gas atomization by which the powder was produced caused the particles to be spherically-shaped and thus the demagnetization factor is high and the permeability low. Core 8 for comparison has a thick oxide layer so its permeability is low. Core 9 for comparison was subjected to high-temperature annealing, so the powder became sintered, thus increasing permeability in the low-frequency range but giving inferior properties in high-frequency region. Core 10 for comparison is made from iron carbonyl powder so while the high-frequency properties is good, the absolute value of the permeability is low.

FIG. 1 shows the variation of permeability with frequency for several cores in Table 1 fabricated by the same steps as above. The cores on the graph are cores 2 and 8 of the invention and cores 4, 5 and 10 for comparison. Core 2 of the invention exhibits high permeability even at frequencies above 10 MHz, while the permeability of the cores for comparison begins to drop off at around 1 MHz.

Thus it is evident that the cores of the invention have good high-frequency magnetic properties.

We claim:

1. An Fe-Si alloy powder core comprising an insulating binder and an alloy powder of an average particle diameter of 10–100 μm, produced by water atomization, in which the composition by weight of the alloy powder is 2–12% silicon and 0.05–0.95% oxygen with the balance being essentially iron.

2. An Fe-Si alloy powder core according to claim 1, in which the composition by weight of the alloy powder is 2–12% silicon, 0.05–0.95% oxygen, and less than 3% Al, Cr and Ti separately or combined, with the balance being essentially iron.

3. A process of manufacturing an Fe-Si alloy powder core comprising the steps of:

producing by water atomization an alloy powder of an average particle diameter of 10–100 μm, in which the alloy powder comprises by weight 2–12% silicon and 0.05–0.95% oxygen with the balance being essentially iron, adding an insulating binder to alloy powder of the above composition, compacting the resulting mixture and curing the resulting compacts.

4. The process according to claim 3 in which said alloy powder additionally comprises a member selected from the group consisting of Al, Cr Ti, and mixtures thereof, in a content of less than 3% by weight.

5. The process of claim 3 in which the compacts are heat-treated in an inert atmosphere at a temperature between 500° C. and 950° C.

6. The process of claim 4 in which the compacts are heat-treated in an inert atmosphere at a temperature between 500° C. and 950° C.

* * * * *